US006167987B1

(12) United States Patent
Jensen

(10) Patent No.: US 6,167,987 B1
(45) Date of Patent: Jan. 2, 2001

(54) ADJUSTABLE ROOFING SCAFFOLD ASSEMBLY AND METHOD OF USE

(76) Inventor: Craig Jensen, 11 Elmwood St., Naugatuck, CT (US) 06770

( * ) Notice: Under 35 U.S.C. 154(b), the term of this patent shall be extended for 0 days.

(21) Appl. No.: 09/440,000

(22) Filed: Nov. 15, 1999

(51) Int. Cl.[7] ..... E04G 3/00
(52) U.S. Cl. ..... 182/45; 248/237
(58) Field of Search ..... 182/45; 248/237, 248/354.5

(56) References Cited

U.S. PATENT DOCUMENTS

| | | | | |
|---|---|---|---|---|
| 1,340,492 | * | 5/1920 | McLanson | 248/237 |
| 1,592,384 | * | 7/1926 | Peck | 248/237 |
| 1,730,618 | * | 10/1929 | Mayo | 248/354.5 |
| 3,292,734 | | 12/1966 | Swanberg . | |
| 4,450,935 | | 5/1984 | Gustavus . | |
| 4,592,446 | * | 6/1986 | White | 182/189 |
| 4,695,023 | | 9/1987 | McCafferty . | |
| 4,972,922 | | 11/1990 | Levine . | |
| 5,165,642 | | 11/1992 | Rihaly . | |
| 5,320,194 | | 6/1994 | Bredijk . | |
| 5,513,826 | | 5/1996 | Labaron . | |
| 5,590,863 | * | 1/1997 | Sasaki | 248/354.5 |
| 5,624,006 | | 4/1997 | Richardson, Jr. . | |
| 5,887,406 | | 3/1999 | Bond . | |
| 5,908,083 | | 6/1999 | Hamilton . | |

FOREIGN PATENT DOCUMENTS

| | | | | |
|---|---|---|---|---|
| 836640 | * | 1/1920 | (CH) | 248/354.5 |

* cited by examiner

*Primary Examiner*—Alvin Chin-Shue
(74) *Attorney, Agent, or Firm*—John H. Crozier

(57) ABSTRACT

In a preferred embodiment, a scaffold assembly for use on a roof, including: a base for placement on a first plank disposed on a scaffold bracket attached to the roof; an outer member having a lower end attached to the base; an inner member telescopingly received in the outer member and attachable to the outer member at at least one lengthwise location; and an upper plank support attached to an upper end of the inner member for placement thereon of a second plank.

12 Claims, 5 Drawing Sheets

ADJUSTABLE ROOFING SCAFFOLD ASSEMBLY AND METHOD OF USE

BACKGROUND OF THE INVENTION

1. Field of the Invention

The present invention relates to roofing scaffolds generally and, more particularly, but not by way of limitation, to a novel adjustable roofing scaffold assembly and method of use that uses a minimum of nails inserted through shingles on the roof.

2. Background Art

Various types of roofing scaffolds are used by roofers and carpenters to support one or more workmen while working on a roof. Typically, a support consisting, usually, of a wooden plank placed horizontally between two or more supports, the supports being secured in position by means of nails inserted through previously laid shingles. When the workmen have finished working on the roof as far up as they can reach, additional supports are nailed through previously laid shingles and another horizontal wooden plank is placed between the supports. When a number of such repositionings are required, a fairly large number of nails must be inserted through the shingles. Such an arrangement is undesirable, however, since each nail hole, although sealed by roofing tar, for example, is a place for the future leakage of water into the roof structure.

Some devices for supporting workmen and items used by workmen are described in the following patents:

U.S. Pat. No. 3,292,734, issued Dec. 20, 1966, to Swanberg, and titled ROOF SCAFFOLD, describes an adjustable scaffold which includes two arms that extend over the peak of a roof. Each of the two arms has provision for two nails to be placed therethrough. Sideways movement of the scaffold requires that the nails be removed and the arms renailed in a new location.

U.S. Pat. No. 4,450,935, issued May 29, 1984, to Gustavus, and titled PORTABLE ADJUSTABLE ROOF PLATFORM, describes a roof platform that fits over rungs on a roof ladder. The platform is adjustable by means of a screw.

U.S. Pat. No. 4,695,023, issued Sep. 22, 1987, to McCafferty, and titled PLATFORM ASSEMBLY FOR SLANTED LADDER, describes another roof platform that fits over rungs on a roof ladder. This one is adjustable by means of pins engaging holes defined in side members of the platform.

U.S. Pat. No. 4,972,922, issued Nov. 27, 1990, to Levine, and titled ADJUSTABLE SCAFFOLDING ASSEMBLY, describes an adjustable scaffold support that is used with a conventional extension ladder. The top end of the extension ladder has attached thereto a structure which fits over the peak of a roof. The scaffold support is clamped to the sides of the ladder at any desired location and the slant of the support is adjusted by the top member of the platform engaging teeth formed on supports. A pin prevents the top member from accidentally disengaging from the supports.

U.S. Pat. No. 5,165,642, issued Nov. 24, 1992, to Rihaly, and titled SHINGLE HOLDER, describes a platform for holding shingles on a roof, the platform being frictionally held in place by means of a sandpaper-like material on the underside of the platform. The holder can also be nailed to the roof if necessary.

U.S. Pat. No. 5,320,194, issued Jun. 14, 1994, to Bredijk, and titled ADJUSTABLE ROOFING SCAFFOLD APPARATUS, describes a wheeled carriage for supporting a scaffold. A platform is attached to the carriage and the angle thereof is adjustable by means of its attachment to two arcuate members. A cable is attached to the carriage and to a fixture fitted over the peak of the roof. The carriage is raised up the roof surface by means of a "come-along". In an alternative embodiment, a winch is provided at the roof peak for winching up the carriage.

U.S. Pat. No. 5,513,826, issued May 7, 1996, to Lebaron, and titled SUPPORT APPARATUS FOR STACKING AND CUTTING ROOF SHEATHING, describes a frame that includes hooks that may be placed over the peak of a roof.

U.S. Pat. No. 5,624,006, issued Apr. 29, 1997, to Richardson, Jr., and titled SUPPORT APPARATUS FOR USE ON AN INCLINED ROOF, describes a support that is attached to a ladder having ridge hooks, the support being attached to the ladder by means of rods passing through rungs of the ladder. The selection of the rungs and holes in vertical members is made such that the platform of the support is horizontal.

U.S. Pat. No. 5,887,406, issued Mar. 30, 1999, to Bond, and titled ARTICLE SUPPORT AND TRAY FOR A PITCHED ROOF, describes a support made of foam rubber or other such material to frictionally hold a tray or other articles.

U.S. Pat. No. 5,908,083, issued Jun. 1, 1999, to Hamilton, and titled ADJUSTABLE ROOFWORKER SUPPORT STRUCTURE, describes a scaffolding support having an overpeak member that is adjustable to match the angles of the roof surfaces. That is to which most of the patent is directed; however, FIG. 9 shows extension members that are attached to the basic member by means of pins.

Each of the foregoing devices is unsuitable for supporting scaffolding, requires horizontal relocation of the device when used for placing shingles on a roof, and/or uses a number of nails inserted through the shingles on the roof.

Accordingly, it is a principal object of the present invention to provide a roofing scaffold assembly and method suitable for placing shingles on a roof and that require only a minimum of nails to be inserted through shingles on the roof.

It is a further object of the invention to provide such a roofing scaffold assembly that is adjustable lengthwise.

It is an additional object of the invention to provide such a roofing scaffold assembly and method that are easy to employ.

It is another object of the invention to provide such a roofing scaffold assembly that is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a scaffold assembly for use on a roof, comprising: a base for placement on a first plank disposed on a scaffold bracket attached to said roof; an outer member having a lower end attached to said base; an inner member telescopingly received in said outer member and attachable to said outer member at at least one lengthwise location; and an upper plank support attached to an upper end of said inner member for placement thereon of a second plank.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
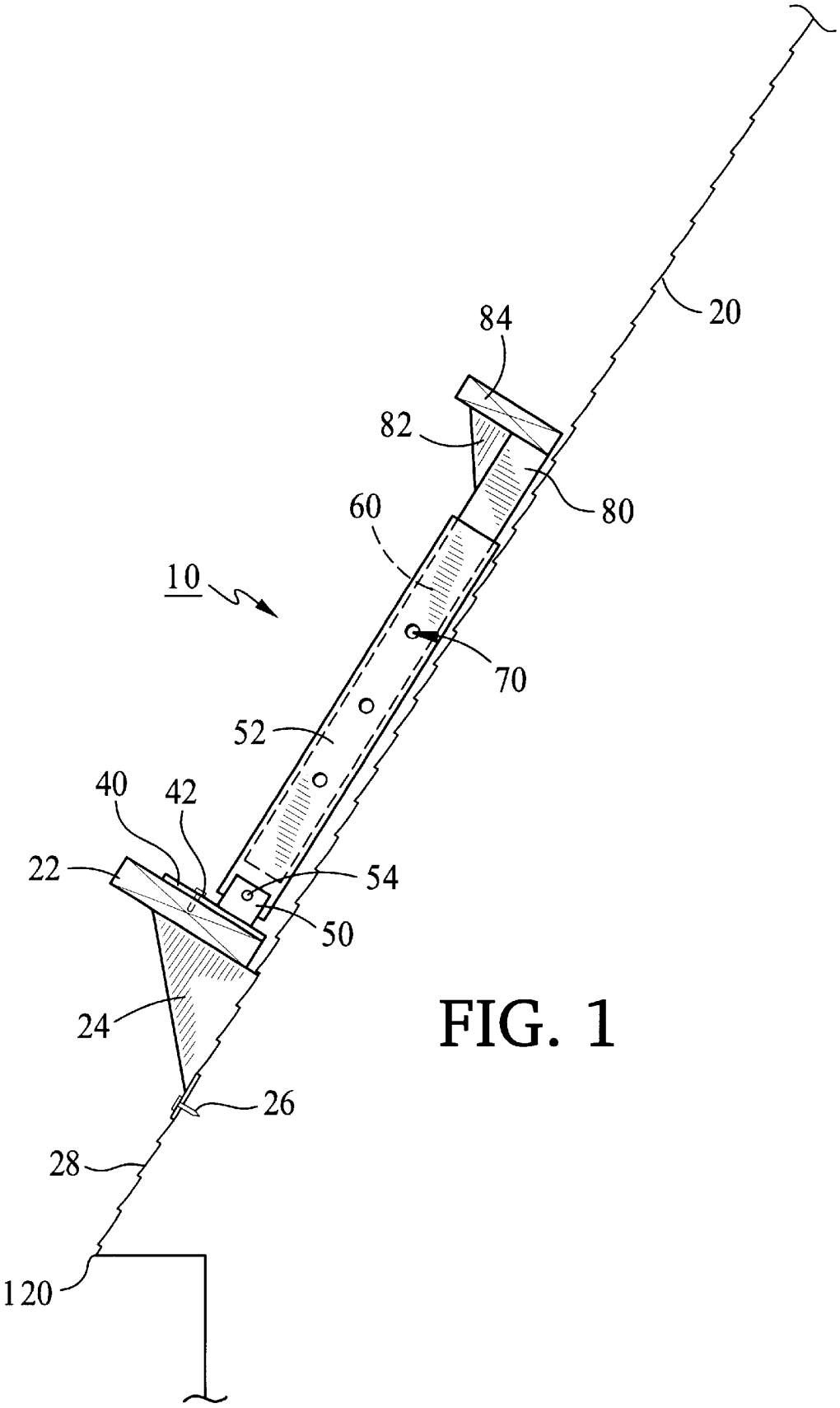
FIG. 1 is a side elevational view of an adjustable roofing scaffold assembly, according to the present invention, in unextended position.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates an adjustable roofing scaffold assembly, constructed according to the present invention, and generally indicated by the reference numeral 10. Scaffold assembly 10 is shown disposed on a roof 20 and is mounted on a first plank 22 disposed on a conventional support bracket 24 that is removably attached to the roof by means of one or more nails 26 inserted through shingles 28 placed on the roof. It will be understood from the following description that nails 26 are the only nails required for securing scaffold assembly 10 to roof 20. It will be further understood that two or more adjustable roofing scaffold assemblies 10 will be provided for working on roof 20, which work may consist of laying shingles or other tasks.

Scaffold assembly 10 includes a base foot 40 removably attached to plank 22 by means of one or more screws or bolts 42. An upwardly open U-shaped support 50 is attached to base foot 40 by suitable means and is, in turn, attached to the lower end of an elongated, square, tubular, outer member 52 by means of a bolt or pin 54. An elongated, square, tubular, inner member 60 is telescopingly inserted into the open end of outer member 52. Outer member 52 and inner member 60 have a plurality of horizontally aligned holes, as at 70, defined therethrough. Fixedly disposed on the distal end of inner member 60 is a cap 80 to which is fixedly attached a support member 82 on which may be placed a second plank 84.

Figure 2:
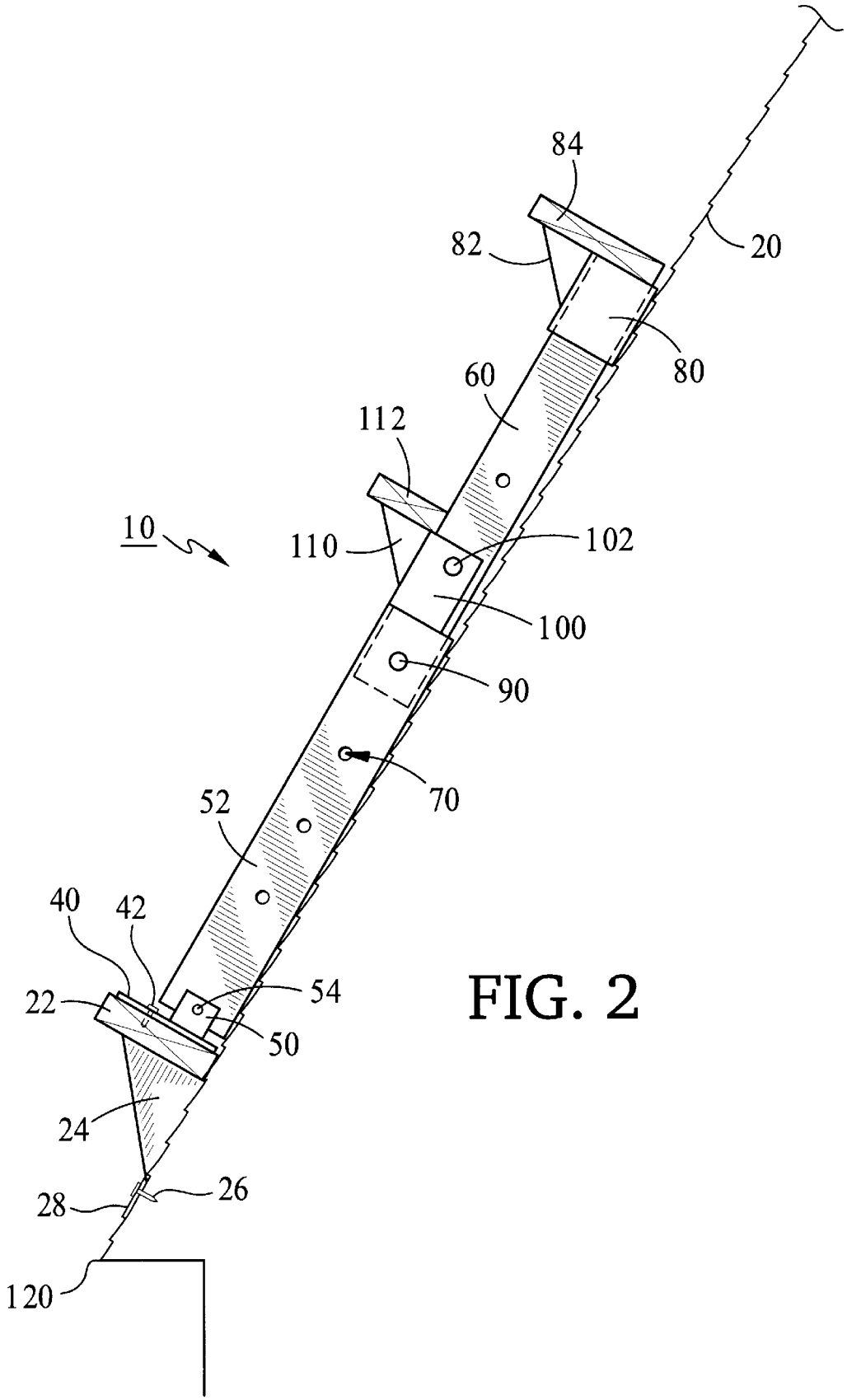
FIG. 2 is a side elevational view of the adjustable roofing scaffold assembly in extended position.

FIG. 2 illustrates inner member 60 partially withdrawn from outer member 52 and supported by the outer member by means of a pin or bolt 90 inserted through selected holes 70. A U-shaped, rectilinear, tubular, intermediate member 100 is placed over inner member 60 and is attached thereto by means of a pin or bolt 102 inserted through selected holes 70 in the inner member. Intermediate member 100 has fixedly attached thereto a bracket 110 on which may be placed a third plank 112.

In use, and assuming that scaffold assembly 10 is being used by a workman laying shingles 28 on roof 20, the workman stands on a ladder or other support means starts at the lower edge 120 (FIG. 1) of roof 20 and lays shingles 28 as far up on the roof as he can reach. Then, supports 24 are nailed to roof 20, first plank 22 is placed on the supports, and the workman stands on the first plank and lays shingles 28 as far up as he can reach. Then, scaffold assembly 10 is attached to first plank 22 and the roofer stands on second plank 84 and lays shingles up as far as he can reach. Then, inner member 60 is withdrawn from outer member 52 (FIG. 2) and pinned by means of pin or bolt 90 and the workman again stands on second plank 84 and lays shingles up as far as he can reach. Intermediate member 100 is attached to inner member 60 so that third plank 112 may be placed on support 110 to provide access and to permit moving of bundles of shingles up the roof.

If required, one or more additional telescoping members (not shown) may be provided in the same manner to permit laying of shingles 28.

While outer member 52 and inner member 60 may have solid front, back, and side walls, in order to reduce weight of scaffold assembly 10, those members may have a wall that is partially open. Weight can be an important consideration, especially when scaffold assembly 10 is constructed of metal.

Figure 3:
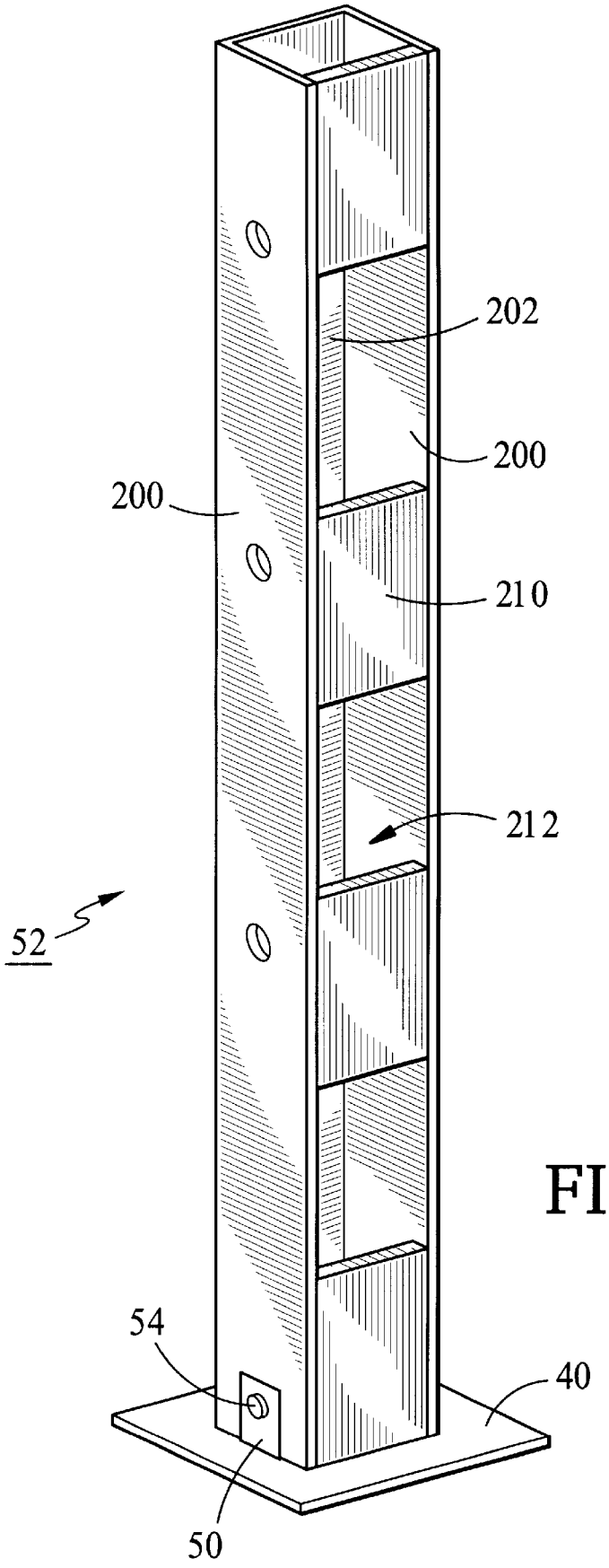
FIG. 3 is a back elevational view of the outer member of the adjustable roofing scaffold assembly.

FIG. 3 illustrates outer member 52 having side walls 200 and front wall 202. Here, rather than providing a solid rear wall, outer member 52 has a rear wall that comprises a plurality of spaced apart segments, as at 210, defining therebetween a plurality of open areas, as at 212. Depending on the material of construction, thickness, and other design considerations, segments 210 may be shorter or longer. As shown, segments 210 have lengths about equal to the lengths of open areas 212.

Figure 4:
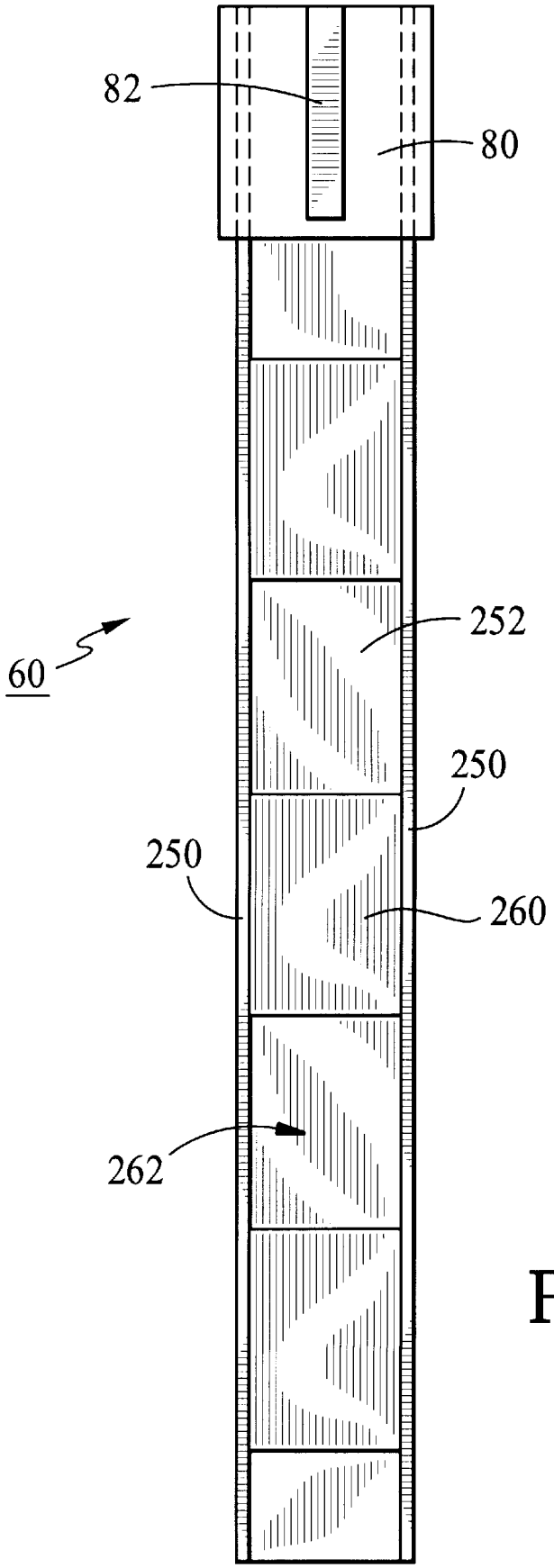
FIG. 4 is a front elevational view of the inner member of the adjustable roofing scaffold assembly.

FIG. 4 illustrates a similar arrangement for inner member 60 having side walls 250 and a rear wall 252. Here, rather than providing a solid front wall, inner member 52 has a front wall that comprises a plurality of spaced apart segments, as at 260, defining therebetween a plurality of open areas, as at 262. Depending on the material of construction, thickness, and other design considerations, segments 260 may be shorter or longer. As shown, segments 210 have lengths about equal to the lengths of open areas 212.

Figure 5:
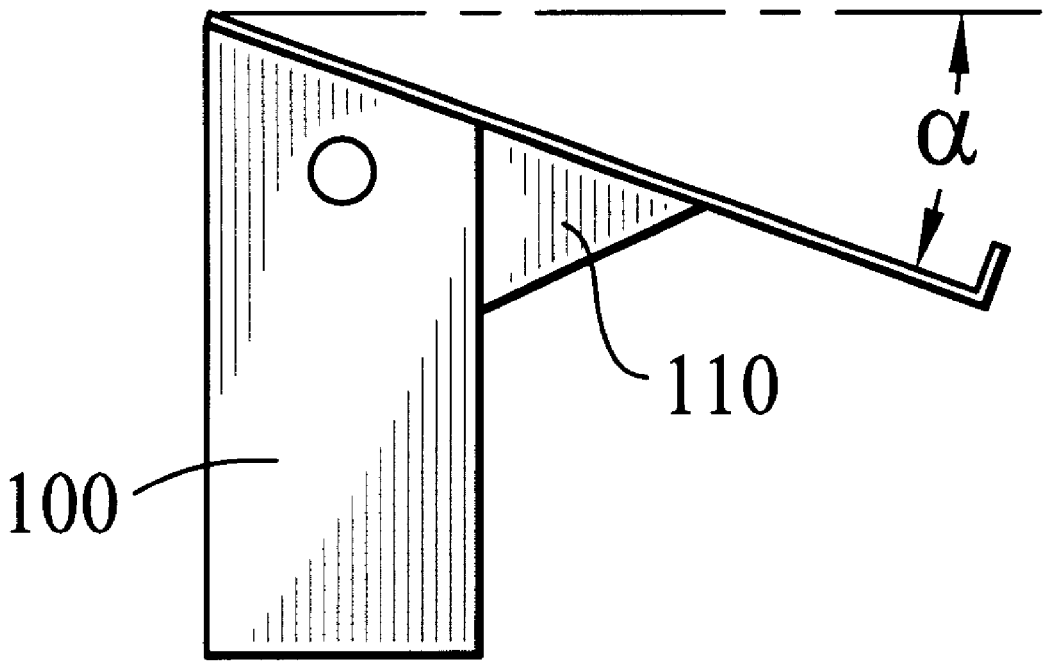
FIG. 5 is a side elevational view of a preferred arrangement for plank supports.

FIG. 5 illustrates a preferred arrangement for the intermediate plank support. Here, the top surface of bracket 110 is angled downwardly from horizontal by an angle alpha so that a plank placed thereon will provide a more comfortable platform on which to stand. The exact value of angle alpha will be chosen depending on the pitch of the typical roof on which scaffold assembly 10 will be used.

Scaffold assembly 10 may be constructed economically of any suitable metallic or polymeric materials and is easily transported and used.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "upper", "lower", "inner", "outer", "inwardly", "outwardly", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A scaffold assembly for supporting a person on a roof, comprising:

(a) a scaffold bracket disposed at a lowest end of said scaffold assembly and attachable to said roof;

(b) a first plank disposed on said scaffold bracket;

(c) a base disposed on said first plank;

(d) an outer member having a lower end attached to said base;

(e) an inner member telescopingly received in said outer member and attachable to said outer member at at least one lengthwise location;

(f) an upper plank support attached to an upper end of said inner member for placement thereon of a second plank; and (g) said scaffold assembly being attachable to said roof solely by means of attachment for said scaffold bracket to said roof.

2. A scaffold assembly for supporting a person on a roof, as defined in claim 1, further comprising: an intermediate plank support removably attachable to said inner member at at least one lengthwise location when said inner member is partially withdrawn from said outer member, for placement on said intermediate plank support of a third plank.

3. A scaffold assembly for supporting a person on a roof, as defined in claim 1, wherein: said inner member is attachable to said outer member by means of a pin or bolt inserted through aligned holes defined through said inner member and said outer member.

4. A scaffold assembly for supporting a person on a roof, as defined in claim 2, wherein: said intermediate plank support is attachable to said inner member by means of a pin or bolt inserted through aligned holes defined through said inner member and said outer member.

5. A scaffold assembly for supporting a person on a roof, as defined in claim 1, wherein: an upper surface of said upper plank support is inclined downwardly with respect to a major axis of said inner member.

6. A scaffold assembly for supporting a person on a roof, as defined in claim 2, wherein: an upper surface of said intermediate plank support is inclined downwardly with respect to a major axis of said inner member.

7. In combination with a roof, a scaffold assembly for supporting a person on said roof, comprising:

(a) a scaffold bracket disposed at a lowest end of said scaffold assembly and attached to said roof;

(b) a first plank disposed on said scaffold bracket;

(c) a base disposed on said first plank;

(d) an outer member having a lower end attached to said base;

(e) an inner member telescopingly received in said outer member and attachable to said outer member at at least one lengthwise location;

(f) an upper plank support attached to an upper end of said inner member for placement thereon of a second plank; and (g) attachment of said scaffold assembly to said roof being solely by means of attachment of said scaffold bracket to said roof.

8. A scaffold assembly for supporting a person on a roof, as defined in claim 7, further comprising: an intermediate plank support removably attachable to said inner member at at least one lengthwise location when said inner member is partially withdrawn from said outer member, for placement on said intermediate plank support of a third plank.

9. A scaffold assembly for supporting a person on a roof, as defined in claim 7, wherein: said inner member is attachable to said outer member by means of a pin or bolt inserted through aligned holes defined through said inner member and said outer member.

10. A scaffold assembly for supporting a person on a roof, as defined in claim 8, wherein: said intermediate plank support is attachable to said inner member by means of a pin or bolt inserted through aligned holes defined through said inner member and said outer member.

11. A scaffold assembly for supporting a person on a roof, as defined in claim 7, wherein: an upper surface of said upper plank support is inclined downwardly with respect to a major axis of said inner member.

12. A scaffold assembly for supporting a person on a roof, as defined in claim 8, wherein: an upper surface of said intermediate plank support is inclined downwardly with respect to a major axis of said inner member.

* * * * *